US008845366B2

(12) United States Patent
Brown et al.

(10) Patent No.: US 8,845,366 B2
(45) Date of Patent: Sep. 30, 2014

(54) APPARATUS, SYSTEM AND METHOD FOR COMPOSITE AND SYMMETRICAL HYBRID ELECTRONIC CONNECTORS

(71) Applicants: Derrick Lewis Brown, Salt Lake City, UT (US); Mikael Cartier, North Salt Lake, UT (US); Donald Brown, Jr., Salt Lake City, UT (US)

(72) Inventors: Derrick Lewis Brown, Salt Lake City, UT (US); Mikael Cartier, North Salt Lake, UT (US); Donald Brown, Jr., Salt Lake City, UT (US)

( * ) Notice: Subject to any disclaimer, the term of this patent is extended or adjusted under 35 U.S.C. 154(b) by 0 days.

(21) Appl. No.: 13/717,529

(22) Filed: Dec. 17, 2012

(65) Prior Publication Data

US 2014/0199888 A1 Jul. 17, 2014

(51) Int. Cl.
*H01R 13/66* (2006.01)

(52) U.S. Cl.
CPC ..... *H01R 13/665* (2013.01)
USPC ..... 439/620.01

(58) Field of Classification Search
USPC ..... 439/620.01, 635, 660, 540.1, 467; 710/62
See application file for complete search history.

(56) References Cited

U.S. PATENT DOCUMENTS 6,491,545 B1 * 12/2002 Spiegel et al. ..... 439/579
6,607,408 B2 * 8/2003 Milan ..... 439/752.5
6,887,098 B1 * 5/2005 Luo et al. ..... 439/540.1
8,282,414 B2 * 10/2012 Zhou et al. ..... 439/541.5
8,363,797 B2 * 1/2013 Binder ..... 379/90.01
8,593,073 B2 * 11/2013 Aldrich et al. ..... 315/291
8,594,510 B2 * 11/2013 Schenk et al. ..... 398/172
2003/0203677 A1 * 10/2003 Spiegel et al. ..... 439/608
2003/0220001 A1 * 11/2003 Milan ..... 439/108
2006/0228932 A1 * 10/2006 Komiyama ..... 439/467
2008/0203928 A1 * 8/2008 Frumau et al. ..... 315/151
2011/0078345 A1 * 3/2011 Lee et al. ..... 710/62
2012/0238146 A1 * 9/2012 Liao et al. ..... 439/660
2013/0137296 A1 * 5/2013 Binder ..... 439/535
2013/0200819 A1 * 8/2013 Valenti ..... 315/293
2014/0056459 A1 * 2/2014 Oishi et al. ..... 381/370

* cited by examiner

*Primary Examiner* — Alexander Gilman
(74) *Attorney, Agent, or Firm* — Steven Rinehart

(57) ABSTRACT

An apparatus, system, and method are disclosed for composite and symmetrical hybrid electronic connectors. Embodiments may include a composite electronic connector 1702 having a set of signals 2402, being divisible into multiple subconnectors 1802, each having a subset of the signals 2404/2408, a harness 204 that combines the subconnectors 1802, distribution 2508 of the set of signals 2402 to the subsets of the signals 2404/2408, a symmetrical electronic connector 208, being connectable in more than one orientation, a tongue 210 within the symmetrical connector 208 having more than one contacting surface 902/1002, each having a set of contacts 404/408, mapping 2512 of the signals 2402 to the contacts 404/408 so as to achieve a correct connection independent of the orientation of the symmetrical connector 208, a cable 106 between the composite connector 1702 and the symmetrical connector 208, and switching 2518 of a power signal 2402-5 on and off.

18 Claims, 13 Drawing Sheets

APPARATUS, SYSTEM AND METHOD FOR COMPOSITE AND SYMMETRICAL HYBRID ELECTRONIC CONNECTORS

CROSS-REFERENCES TO RELATED APPLICATIONS

This application claims priority to U.S. Provisional Patent Application No. 61/634,371 entitled "Reversible USB 3.0 and 2.0" and filed on Feb. 27, 2012 for Derrick Brown, which is incorporated herein by reference.

BACKGROUND OF THE INVENTION

1. Field of the Invention

The present invention relates generally to electronic connectors. More specifically, the present invention relates to hybrid electronic connectors.

2. Description of the Related Art

Electronic connectors are widely used for host computers to communicate with peripheral devices. The Universal Serial Bus ("USB") is a popular standard for such connectors. Compatible devices are used for phones, keyboards, mice, printers, scanners, modems, battery chargers, external hard drives, flash drives, headsets, cables, and the like. The operating system supports compatible devices with easy installation. If the device is a new device, the operating system auto-detects the device and begins a dialog to locate the software driver. If the device has already been installed on computer, the operating system activates the device.

One problem with current connectors is that they become hybridized as connection standards evolve. For example, USB has evolved from revision 1.0 to 2.0 to 3.0, and will no doubt continue to evolve in the future. It is often not entirely clear which revision of the standard is supported by a particular connector.

Another problem with current connectors is that the female and male connectors are not symmetrical to each other. It is not intuitive how the device should be inserted based on its markings. Some computers have their female connectors mounted upside down and some are mounted vertically. From the user's perspective it can be frustrating to determine how to plug it in since it may be in hard-to-see areas. Users often resort to forcing the connection and damaging the connectors.

An additional problem is that connectors are often used to convey data, provide power, or both. It is often not evident from the physical appearance of the connector whether it is a data cable or a power charging cord. Also, if both the computer and the peripheral device are independently powered, the charging function becomes duplicative and wasteful.

SUMMARY

From the foregoing discussion, the inventors have recognized that a long-felt unmet need exists for composite and symmetrical hybrid electronic connectors. Beneficially, such a mechanism would provide a high degree of adaptability and interchangeability between various types of electronic connectors.

The embodiments of the present invention have been developed in response to the present state of the art, and in particular, in response to the problems and needs in the art that remain intractable with currently available inventions. Accordingly, the embodiments have been developed to provide an apparatus, system, and method for composite and symmetrical hybrid electronic connectors that overcome many or all of the above-discussed shortcomings in the art.

The composite electronic connector apparatus is provided with a composite electronic connector including a set of signals, the composite connector being divisible into multiple subconnectors, each subconnector including a subset of the signals, a harness that combines the subconnectors, including corresponding subconnector faces that mate together, and a splitter module that distributes the set of signals to the subsets of the signals.

In one embodiment, mating alignment of the corresponding subconnector faces may be achieved by connecting the subconnectors to an undivided composite connector of opposite gender. In other embodiments, mating alignment may be achieved between the subconnector faces by corresponding pins and holes, by a friction fit, by a keyed slot, by a flexible joint between them along a common edge, and so forth.

In another embodiment, the composite connector may include a Micro Type B Universal Serial Bus ("USB") 3.0 connector. In an embodiment, one subconnector may by be compatible with USB 2.0 and another subconnector may be compatible with USB 3.0.

The symmetrical electronic connector apparatus is provided with a symmetrical electronic connector including a set of signals, the symmetrical connector being connectable in more than one orientation, a tongue disposed within the symmetrical connector, the tongue having more than one contacting surface, each contacting surface including a set of contacts, and a mapper module that maps the signals to the contacts so as to achieve a correct connection independent of the orientation of the symmetrical connector.

In one embodiment, the symmetrical connector may be hybrid, meaning that the set of contacts may be arranged in multiple rows, each row including a subset of contacts. In other embodiments, the symmetrical connector may be either male or female.

In another embodiment, the symmetrical connector may include a Standard Type A USB connector. In a hybrid embodiment, one subset of contacts may embody USB 2.0 and another subset of contacts may embody USB 3.0

A system of the present invention is also presented for composite and symmetrical hybrid electronic connectors. The system may include the composite electronic connector apparatus with the set of signals including a power signal, the symmetrical electronic connector apparatus, and a cable between the composite connector and the symmetrical connector.

In one embodiment, the system may also include a switching module that switches the power signal on and off. In a further embodiment, the switching module may include a mechanical switch in line with the cable. In another embodiment, the splitter module may distribute the power signal to more than one of the subsets of the signals.

In other embodiments, the composite connector may include a Micro Type B USB 3.0 connector and the symmetrical connector may include a Standard Type A USB connector. In a further embodiment, the power signal may be included as a backward-compatible enhancement to USB 3.0.

A method of the present invention is also presented for composite and symmetrical hybrid electronic connectors. The method in the disclosed embodiments substantially includes the steps necessary to carry out the functions presented above with respect to the operation of the described apparatus and system.

In one embodiment, the method may include providing the composite electronic connector apparatus and distributing the set of signals to the subsets of the signals. In another embodiment, the method may include providing the symmetrical electronic connector apparatus and mapping the signals to the contacts so as to achieve a correct connection independent of the orientation of the symmetrical connector.

In a further embodiment, the method may include the step of switching a power signal on and off.

Reference throughout this specification to features, advantages, or similar language does not imply that all of the features and advantages that may be realized with the present invention should be or are in any single embodiment. Rather, language referring to the features and advantages is understood to mean that a specific feature, advantage, or characteristic described in connection with an embodiment is included in at least one embodiment. Thus, discussion of the features and advantages, and similar language, throughout this specification may, but do not necessarily, refer to the same embodiment.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

These features and advantages of the embodiments will become more fully apparent from the following description and appended claims, or may be learned by the practice of the embodiments as set forth hereinafter.

BRIEF DESCRIPTION OF THE DRAWINGS

In order that the advantages of the invention will be readily understood, a more particular description of the invention will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. Where a module or portions of a module are implemented in software, the software portions are stored on one or more computer readable media.

Reference to a computer readable medium may take any form capable of storing machine-readable instructions on a digital processing apparatus. A computer readable medium may be embodied by a transmission line, a compact disk, digital-video disk, a magnetic tape, a Bernoulli drive, a magnetic disk, a punch card, flash memory, integrated circuits, or other digital processing apparatus memory device.

Figure 1:
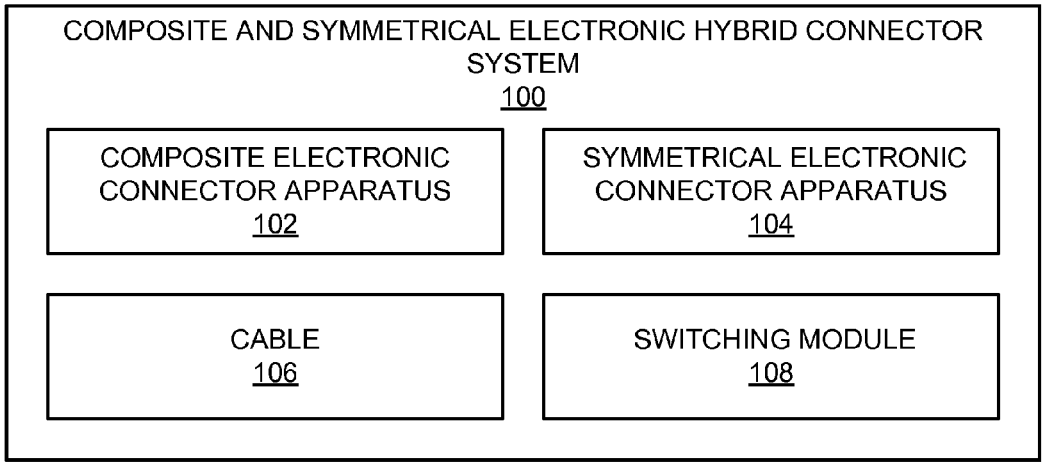
FIG. 1 is a schematic block diagram illustrating one embodiment of a system for composite and symmetrical hybrid electronic connectors.

FIG. 1 is a schematic block diagram illustrating one embodiment of a system 100 for composite and symmetrical hybrid electronic connectors. The system 100 may comprise a composite electronic connector apparatus 102, a symmetrical electronic connector apparatus 104, a cable 106, and a switching module 108 that may switch a power signal on and off. In one embodiment, the composite connector apparatus 102 may be at one end of the cable 106, the symmetrical connector apparatus 104 may be at another end of the cable 106.

The switching module 108 may be in line with the cable 106, and in other embodiments it may be integrated with the apparatus 102/104. In one embodiment, the switching module 108 may comprise a mechanical switch that is operated manually. In another embodiment, it may comprise an electromechanical switch that is operated remotely. In a further embodiment, it may comprise a digital switching circuit that is programmatically controlled, and so forth.

Figure 2A:
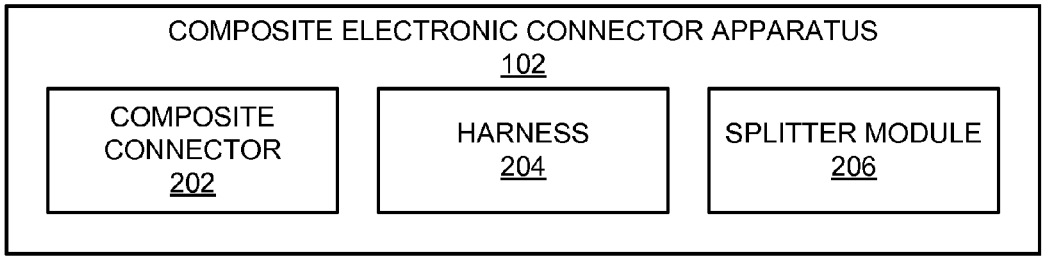
FIG. 2A is a schematic block diagram of a composite electronic connector apparatus.

FIG. 2A is a schematic block diagram of the composite electronic connector apparatus 102, which may comprise a composite connector 202 having subconnectors joined by a harness 204, and a splitter module 206 that divides the composite connector 202 into the subconnectors.

The splitter module 206 may be in line with the cable 106, and in other embodiments it may be integrated with the composite connector 202. In one embodiment, the splitter module 108 may comprise a daisy chain, wye, or other branching topology for multi-way distribution of signals. In another embodiment, it may comprise an analog circuit providing passive and/or active output copies of input signals. In a further embodiment, it may comprise a digital demultiplexing circuit that is programmatically controlled, and so forth.

Figure 2B:
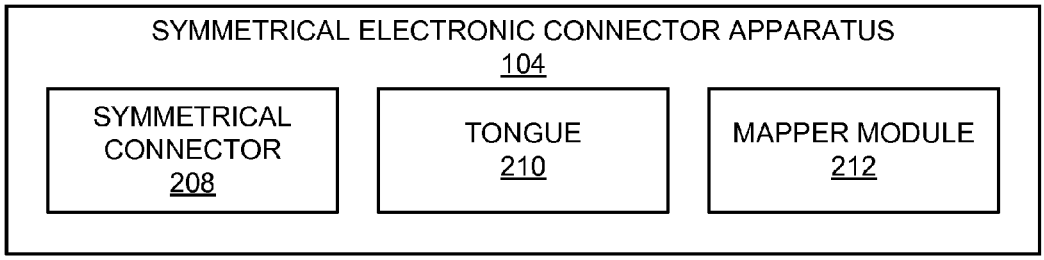
FIG. 2B is a schematic block diagram of a symmetrical electronic connector apparatus.

FIG. 2B is a schematic block diagram of the symmetrical electronic connector apparatus 104, which may comprise a symmetrical connector 208 having a tongue 210, with a mapper module 212 that maps a set of signals to a set of contacts on a contacting surface of the tongue 210.

The mapper module 206 may reside separately within the symmetrical connector 208, and in other embodiments it may be integrated with the tongue 210. In one embodiment, the mapper module 108 may comprise discrete wiring to each contact. In another embodiment, it may comprise a printed circuit with a trace to each contact. In a further embodiment, it may comprise a digital routing circuit that is programmatically controlled, and so forth.

Figure 3:
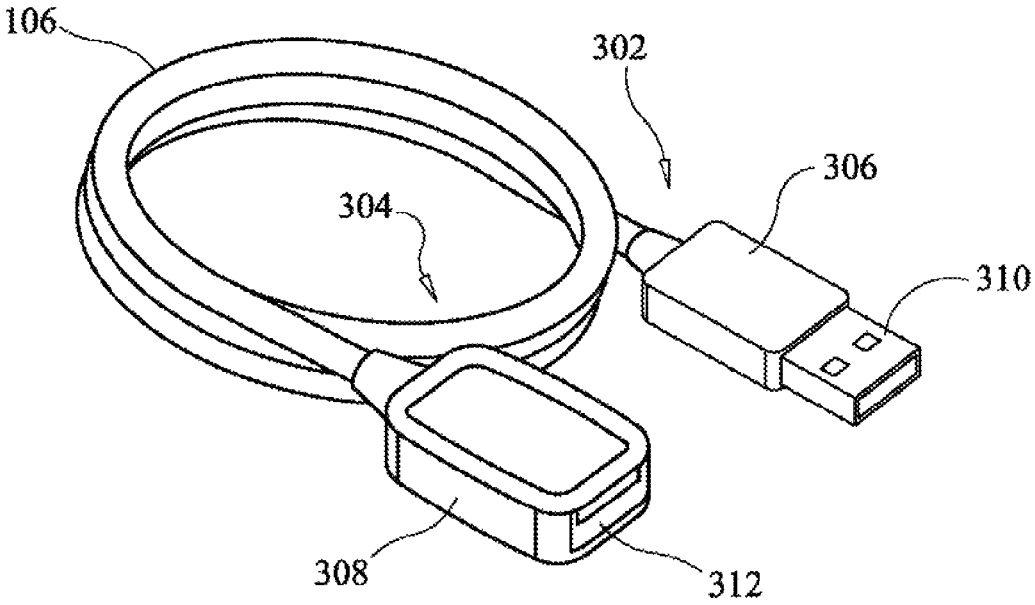
FIG. 3 is a perspective view of an embodiment of the system.

FIG. 3 is a perspective view of an embodiment of the system 100. The cable 106 has a male connector 302 at one end and a compatible female connector 304 at the other end. The connectors 302 and 304 may or may not be hybrid. A hybrid connector may be backward compatible with a regular (non-hybrid) connector. The male metal shielding shell 310 protrudes from the male housing 306, while the female metal shielding shell 312 is recessed within the female housing 308. The female shell 312 is slightly larger than the male shell 310, to permit snug insertion, thereby holding the connection firmly together and maintaining satisfactory continuity of the electrical shielding of the system 100.

In an embodiment, the connectors 302 and 304 may comprise Standard Type A Universal Serial Bus ("USB") connectors. In various further embodiments, the system 100 may be compatible with the USB 2.0 Standard ("USB 2.0"), the USB 3.0 Standard ("USB 3.0"), or may be a hybrid of USB 2.0 and USB 3.0 ("USB 2.0/3.0").

The male connector 302 may be referred to as a plug or tip and the female connector 304 may be referred to as a socket or receptacle. In some embodiments (not shown), the connector 302/304 may be incorporated directly into a computer, peripheral device, or the like, rather than a separate housing 306/308 at the end of a cable 106. For example, a flash drive may have a male tip 302 that plugs into a female socket 304 in the casing of a personal computer. In such an embodiment, the flash drive would comprise the housing 306 and the computer would comprise the housing 308. Indeed, where multiple devices are being connected, the female socket 304 may often be deployed in the more stationary of the devices, while the male plug 302 may be deployed in the more portable of the devices or in a cable 106. Other examples may include a socket 304 residing directly in an AC power adapter for recharging applications, connectors 302/304 of differing types residing together in a small form-factor adapter to convert one type of connection to another, hubs and other networking devices with multiple sockets 304, and so forth.

Figure 4:
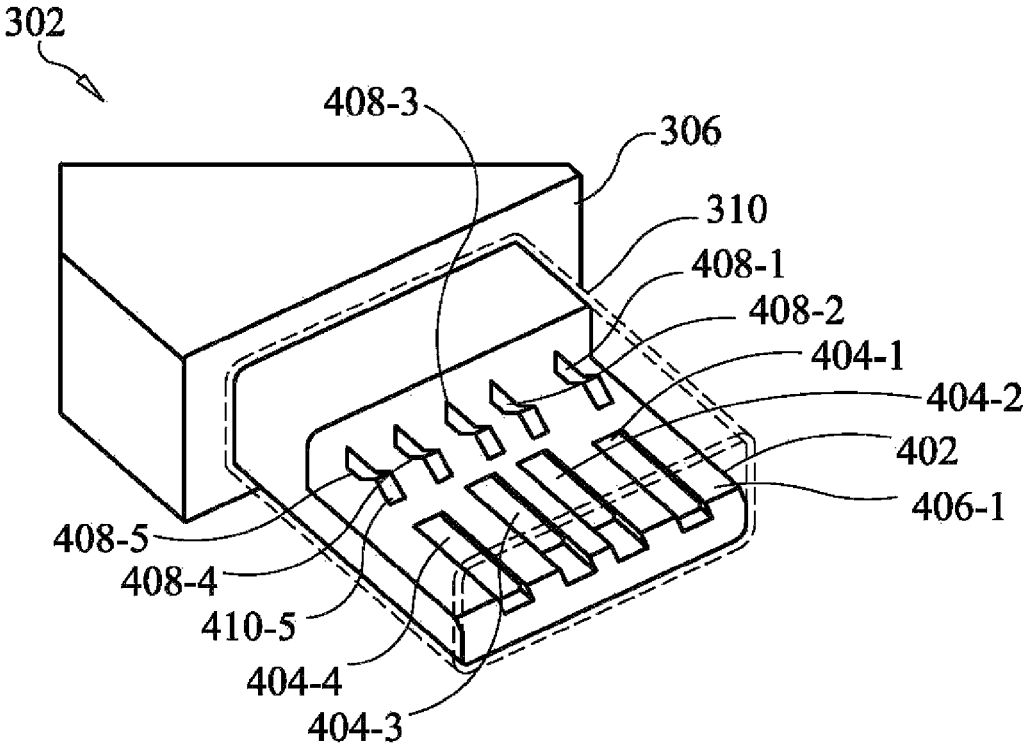
FIG. 4 is a cutaway perspective view of a hybrid male connector.

FIG. 4 is a cutaway perspective view of a hybrid male connector 302. Within the shell 310 a male substrate 402 supports contacts 404 and 408. The connector 302 is hybrid in that the subset of contacts 404 and the subset of contacts 408 are arranged in separate rows and operate independently of one another. This configuration allows the hybrid connector 302 to connect to and interoperate with a compatible female connector 304 having contacts that positionally correspond to either or both of the subsets 404 and 408

Each contact 404 has a raised elastic portion 406 and each contact 408 has a raised elastic portion 410. When a connection is made, the elastic portions 406 and 410 are slightly compressed against corresponding contacts of the female connector 304, thereby exerting sufficient pressure to maintain a solid electrical connection.

Figure 5:
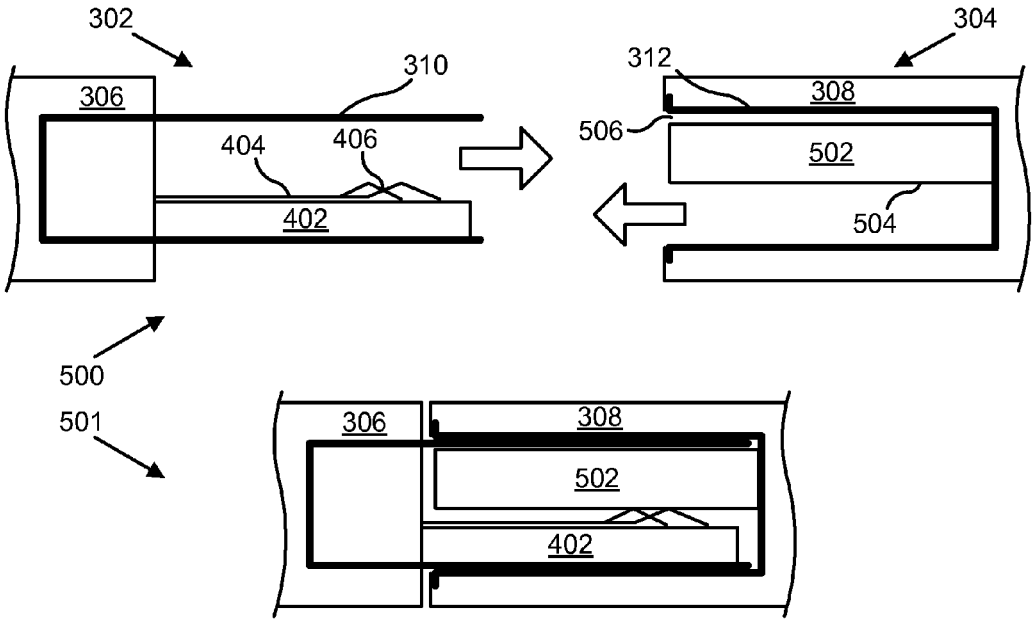
FIG. 5 is a lateral sectional view of a regular male connector engaging a regular female connector.

In an embodiment, the contacts 404 may embody USB 2.0 and the contacts 408 may embody USB 3.0. In the USB 2.0 embodiment, contact 404-1 is the power line ("VBUS"), contact 404-2 is the positive data line of the differential pair ("D+"), contact 404-3 is the negative data line of the differential pair ("D−"), and contact 404-4 is the ground line ("GND"). In the USB 3.0 embodiment, contact 408-1 is the positive signal line of the receiving twisted pair ("RX+"), contact 408-2 is the negative signal line of the receiving twisted pair ("RX−"), contact 408-3 is the ground line ("GND"), contact 408-4 is the positive signal line of the transmission twisted pair ("TX+"), and contact 408-5 is the negative signal line of the transmission twisted pair ("TX−"), FIG. 5 is a lateral sectional view of a regular male connector 302 engaging a regular female connector 304. The female connector 304 has contacts 504 disposed on a female substrate 502. The female contacts 504 are mounted flat against the substrate 502 and thus not directly visible in this view, but they correspond positionally to the male contacts 404, so as to make contact with and slightly compress the elastic portions 406 when a connection is made by inserting the male connector 302 into the female connector 304, transitioning from an open position 500 to a closed position 501.

Note the slight gap 506 between the female shell 312 and the female substrate 502, thus allowing the male shell 310 to slide between them when the male connector 302 is inserted into the female connector 304. With all of the elements thus sandwiched snugly together 501, the elastic portions 406 of the male contacts 404 are thereby compressed against the flat female contacts 502, insuring satisfactory electrical continuity.

Figure 6:
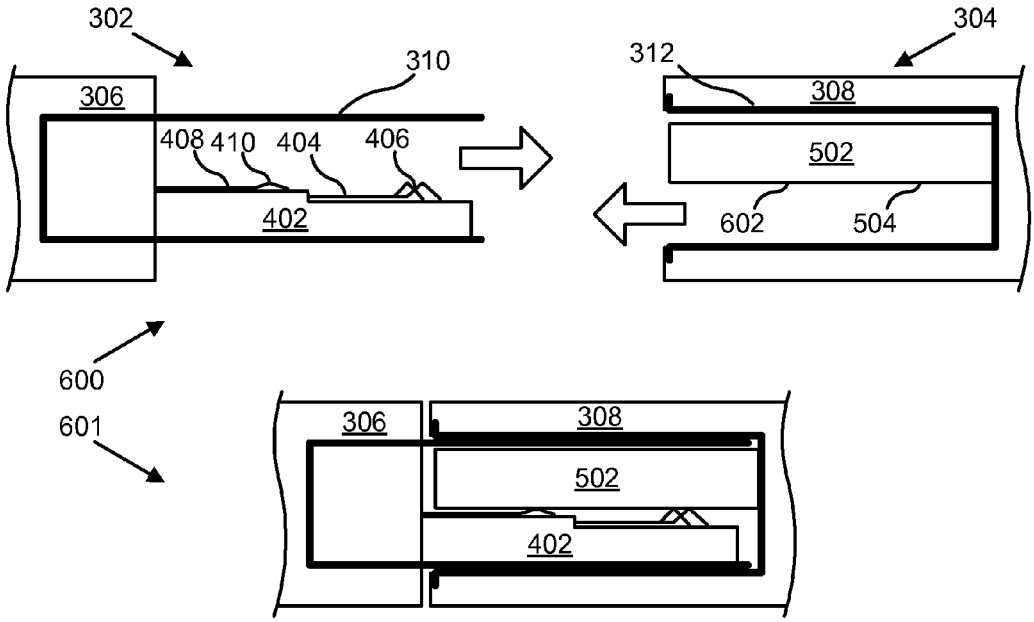
FIG. 6 is a lateral sectional view of a hybrid male connector engaging a hybrid female connector.

FIG. 6 is a lateral sectional view of a hybrid male connector 302 engaging a hybrid female connector 304. The female connector 304 has contacts 602 in addition to the contacts 504 disposed on the female substrate 502. The female contacts 602 are mounted flat against the substrate 502 and thus not directly visible in this view, but they correspond positionally to the male contacts 408, so as to make contact with and slightly compress the elastic portions 410 when a connection is made by inserting the male connector 302 into the female connector 304, transitioning from an open position 600 to a closed position 601. With all of the elements thus sandwiched snugly together 601, the elastic portions 410 of the male contacts 408 are thereby compressed against the flat female contacts 602, insuring satisfactory electrical continuity.

Observe that the hybrid male connector 302 of FIG. 6 would fit into the regular female connector 304 of FIG. 5, and that the hybrid female connector 304 of FIG. 6 would also accept the regular male connector 302 of FIG. 5. In either case, the elastic portions 406 of the contacts 404 would make contact with the flat contacts 504. In contrast, the absence of the flat contacts 602 in the first case and the absence of the contacts 408 with the elastic portions 410 in the second case would result in no electrical contact between them in either case, while not preventing the mechanical interchangeability of the regular and hybrid connectors, as already observed. This illustrates the backward compatibility of a hybrid connector to a regular connector.

In an alternate embodiment, the substrate 402 and its associated elastic contacts 404/408 could have been installed in the female connector 304, with the substrate 502 and its associated flat contacts 504/602 being installed in the male connector 302, and the connection between connectors 302 and 304 would still have worked properly, both mechanically and electrically. In other words, the internal structure of the connectors 302/304 is interchangeable, independent of gender.

Figure 7:
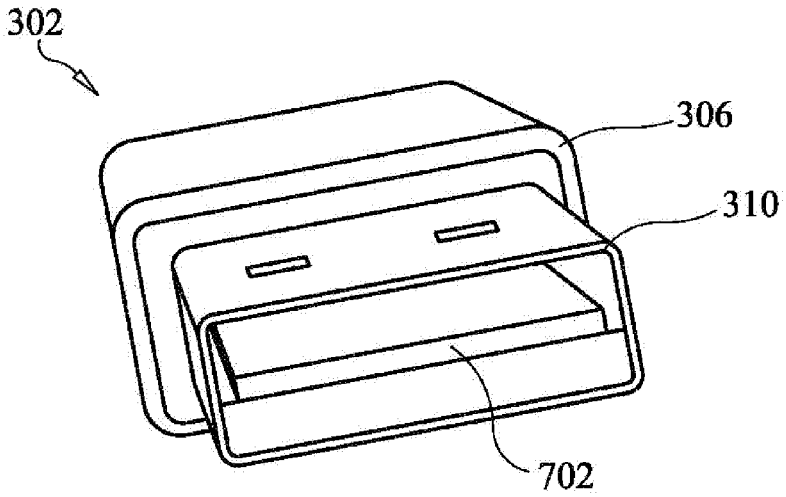
FIG. 7 is a perspective view of symmetrical male connector having a regular reversible tongue.

FIG. 7 is a perspective view of symmetrical male connector 302 having a reversible tongue 702. As can been seen, the connector possesses bilateral horizontal symmetry. In other words, if its horizontal orientation is inverted (i.e. rotated by 180 degrees) its shape and appearance remain unchanged.

Figure 8:
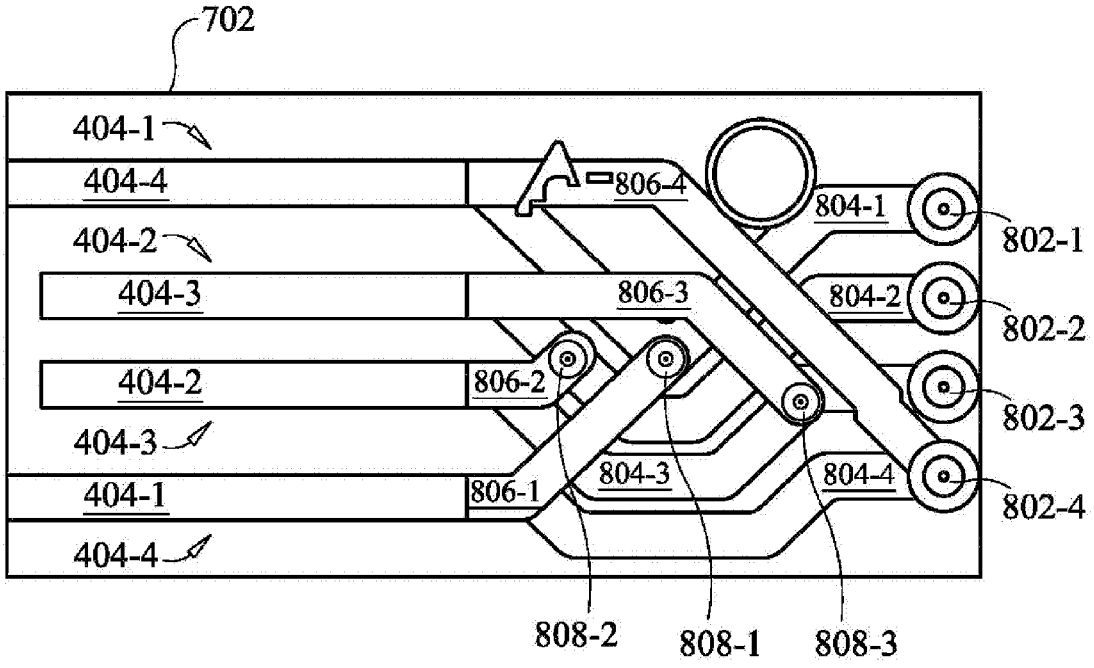
FIG. 8 is a printed circuit layout diagram of a regular tongue.

FIG. 8 is a printed circuit layout diagram of a regular reversible tongue 702. Terminals 802 are configured to receive signals from the cable 106 (not shown). The signals are conveyed from the terminals 802-1:3 to top contacts 404-1:3 by way of bottom traces 804-1:3 to vias 808-1:3 to top traces 806-1:3, and from terminal 802-4 to top contact 404-4 by way of top trace 806-4. The signals are also conveyed from the terminals 802 to bottom contacts 404 through bottom traces 804-1:4. The bottom contacts 404-1:4 lie on the underside of the tongue 702, directly beneath top contacts 404-4:1, and thus are not visible in this view, but are indicated by arrows.

If the reversible tongue 702 were inverted in its orientation, such that its top and bottom surfaces were to exchange places and the underside became visible, it can be seen that the bottom contacts 404-1:4 would appear in exactly the same position and order as the top contacts 404-4:1 do in the original orientation depicted in the figure. In this example, the bottom traces 804, top traces 806, and vias 808 together comprise one embodiment of a mapper module 212.

In an embodiment, the contacts 404 may embody USB 2.0. Note that in such an embodiment, the ground signal is conveyed directly from terminal 802-4 to both the top and bottom contacts 404 by way of the top and bottom traces 806-4 and 804-4, respectively, without an intervening via 808. This may provide more reliable grounding of the connector 302. Furthermore, the juxtaposition of top trace 806-4 directly above bottom traces 804-2:3 may provide a ground plane effect that beneficially reduces crosstalk between top contacts 404-3:2 and bottom contacts 404-2:3.

Alternate embodiments are possible with greater than 2-way symmetry. For example, the connector 302 and tongue 702 could be in the shape of an equilateral triangle for three-way symmetry, a square for 4-way symmetry, and so forth, with a set of contacts 404/408 identically disposed on each contacting surface of the tongue 702, appropriately mapped from a common set of terminals 802 by a mapper module 212.

Figure 9:
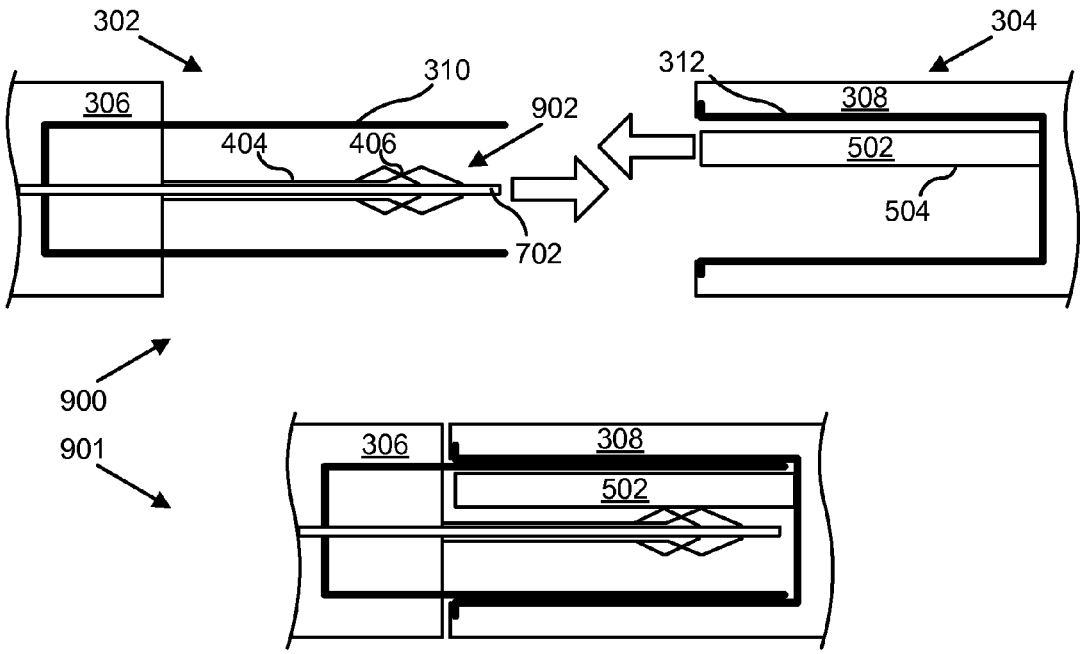
FIG. 9 is a lateral sectional view of a symmetrical regular male connector engaging a regular female connector in one orientation.

FIG. 9 is a lateral sectional view of a symmetrical regular male connector 302 engaging a regular female connector 304 in one orientation. The male connector 302 has top contacts 404 disposed on a top contacting surface 902 of the tongue 702. The female connector has contacts 504 disposed on a female substrate 502. The female contacts 504 are mounted flat against the substrate 502 and thus not directly visible in this view, but they correspond positionally to the male contacts 404, so as to make contact with and slightly compress the elastic portions 406 when a connection is made by inserting the male connector 302 into the female connector 304, transitioning from an open position 900 to a closed position 901.

Observe that the tongue 702 is cantilevered out from the male housing 306, thus reducing deflection of the tongue 702 when the elastic portions 406 of the male contacts 404 are compressed against the flat female contacts 504, insuring satisfactory electrical continuity. In a further embodiment, the tongue 702 may be constructed of a thin but rigid material in order to further minimize deflection under pressure. In an embodiment, the rigid material may comprise a high-strength laminate such as fiberglass or the like.

Figure 10:
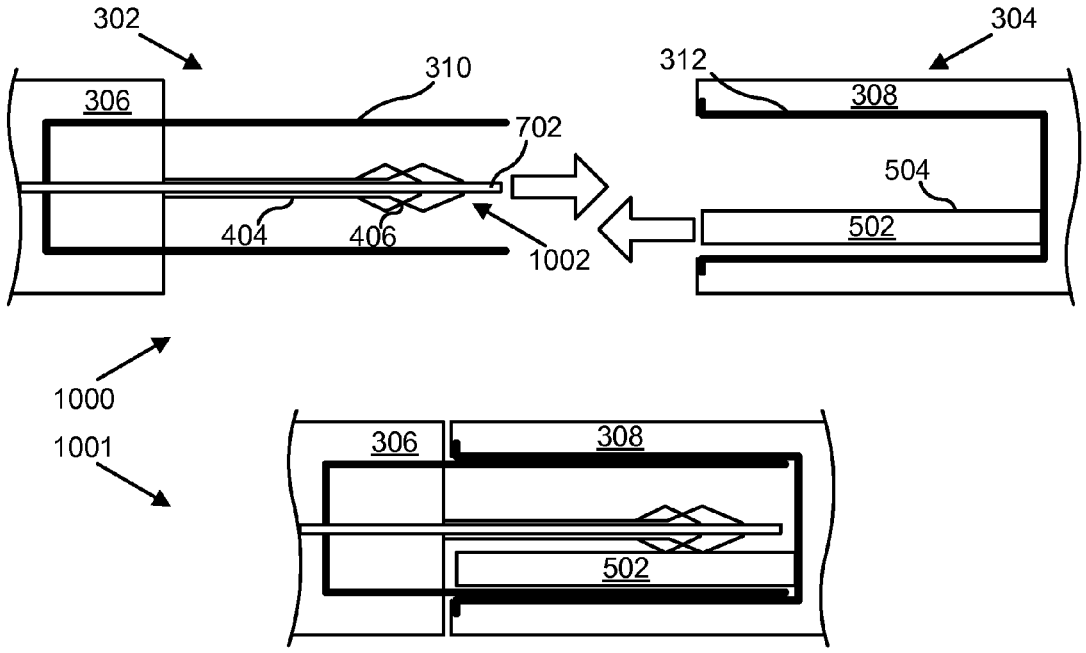
FIG. 10 is a lateral sectional view of a symmetrical regular male connector engaging a regular female connector in a reversed orientation.

FIG. 10 is a lateral sectional view of a symmetrical regular male connector 302 engaging a regular female connector 304 in a reversed orientation. The male connector 302 has bottom contacts 404 disposed on a bottom contacting surface 1002 of the tongue 702. The female connector has contacts 504 disposed on a female substrate 502. The female contacts 504 are mounted flat against the substrate 502 and thus not directly visible in this view, but they correspond positionally to the male contacts 404, so as to make contact with and slightly compress the elastic portions 406 when a connection is made by inserting the male connector 302 into the female connector 304, transitioning from an open position 1000 to a closed position 1001.

In an alternate embodiment, the tongue 702 and its associated elastic contacts 404 could have been installed in the female connector 304, with the substrate 502 and its associated flat contacts 504 being installed in the male connector 302, and the connection between connectors 302 and 304 would still have worked properly, both mechanically and electrically. In other words, the internal structure of the connectors 302/304 is interchangeable, independent of gender.

Figure 11:
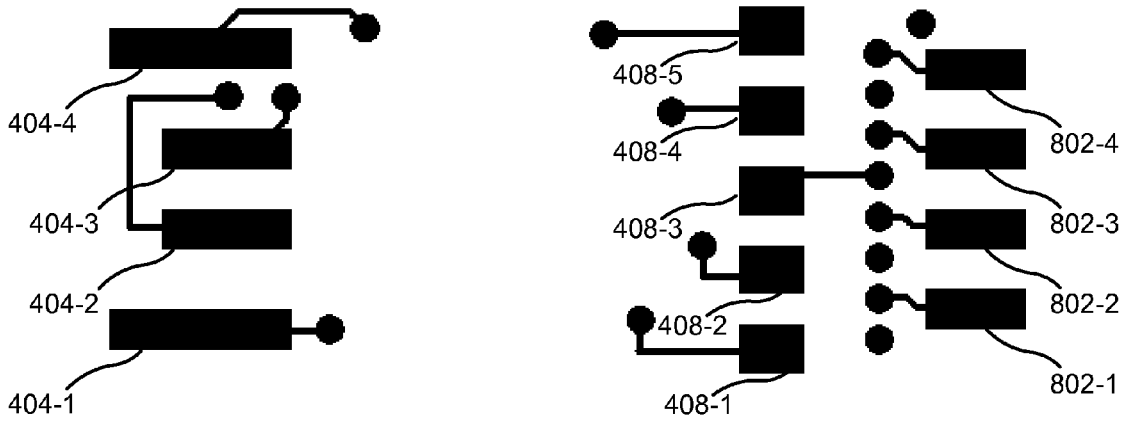
FIG. 11 is a printed circuit layout diagram of a top layer of a hybrid reversible tongue.

FIG. 11 is a printed circuit layout diagram of a top layer of a hybrid reversible tongue 702. Similar to the regular reversible tongue 702 of FIG. 8, terminals 802 and top contacts 404 are provided. In addition, a second set of top contacts 408 are also provided.

Figure 12:
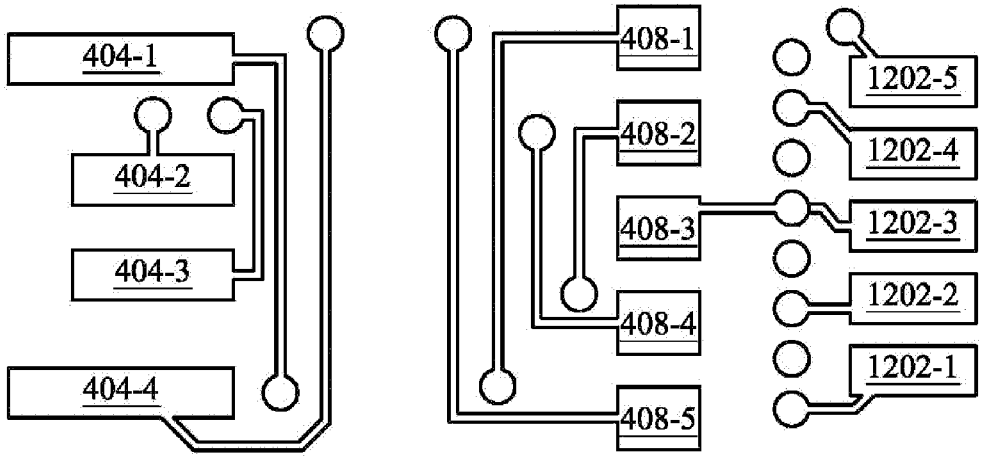
FIG. 12 is a printed circuit layout diagram of a bottom layer of the hybrid reversible tongue.

FIG. 12 is a printed circuit layout diagram of a bottom layer of the hybrid reversible tongue 702. Similar to the regular reversible tongue 702 of FIG. 8, bottom contacts 404 are provided. In addition, a second set of bottom contacts 408 and corresponding terminals 1202 are also provided.

Figure 13:
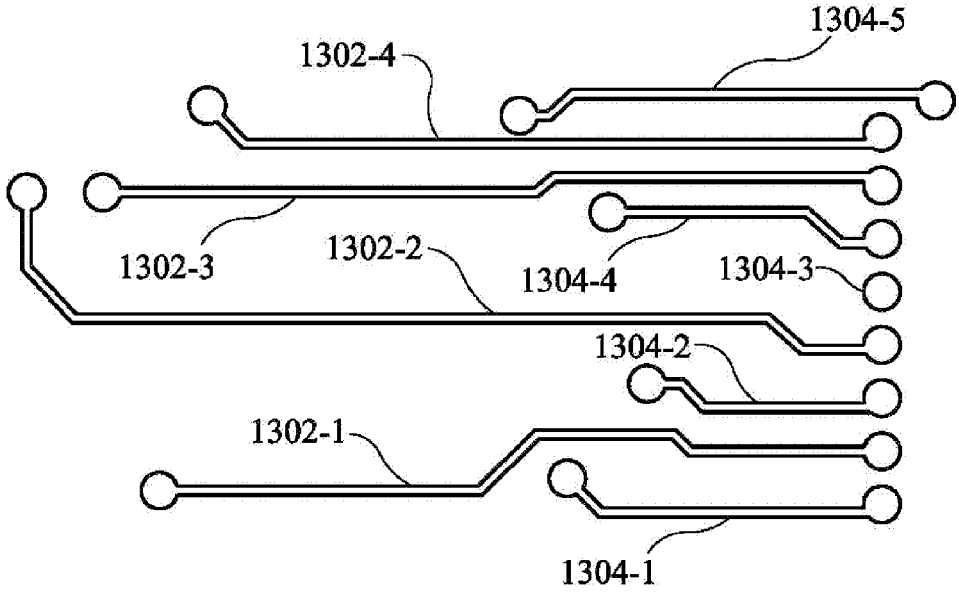
FIG. 13 is a printed circuit layout diagram of a middle layer of the hybrid reversible tongue.

FIG. 13 is a printed circuit layout diagram of a middle layer of the hybrid reversible tongue 702. Traces 1302 are provided to connect terminals 802 to top contacts 404 and bottom contacts 404. Traces 1304 are provided to connect terminals 1202 to top contacts 408 and bottom contacts 408.

Figure 14:
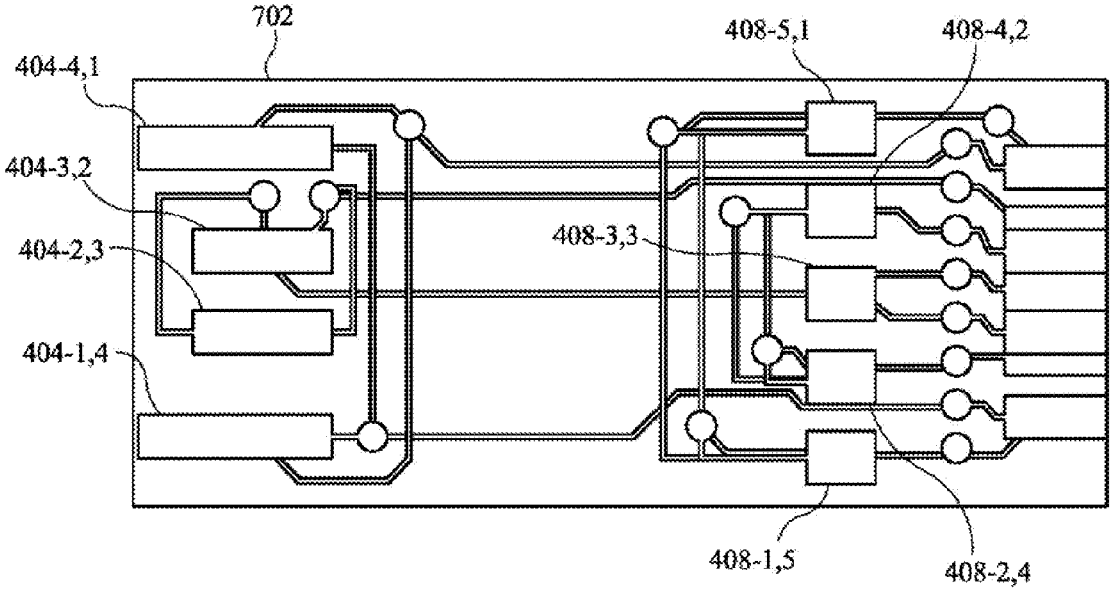
FIG. 14 is a printed circuit layout diagram showing an overlay of the foregoing three layers of the hybrid reversible tongue.

FIG. 14 is a printed circuit layout diagram showing an overlay of the foregoing three layers of the hybrid reversible tongue 702. Observe how the vias of traces 1302 align with vias of traces to terminals 802 and top and bottom contacts 404. Similarly, observe how the vias of traces 1304 align with vias of traces to terminals 1202 and top and bottom contacts 408. The bottom contacts 404-1:4 and 408-1:5 lie on the underside of the tongue 702, directly beneath top contacts 404-4:1 and 408-5:1, respectively, and thus are not visible in this view, but are indicated by a comma following the top reference number and preceding the bottom reference number.

If the reversible tongue 702 were inverted in its orientation, such that its top and bottom surfaces were to exchange places and the underside became visible, it can be seen that the bottom contacts 404-1:4 and 408-1:5 would appear in exactly the same position and order as the top contacts 404-4:1 and 408:5:1 do in the original orientation depicted in the figure. In this example, the traces and vias of all three layers together comprise one embodiment of a mapper module 212.

Figure 15:
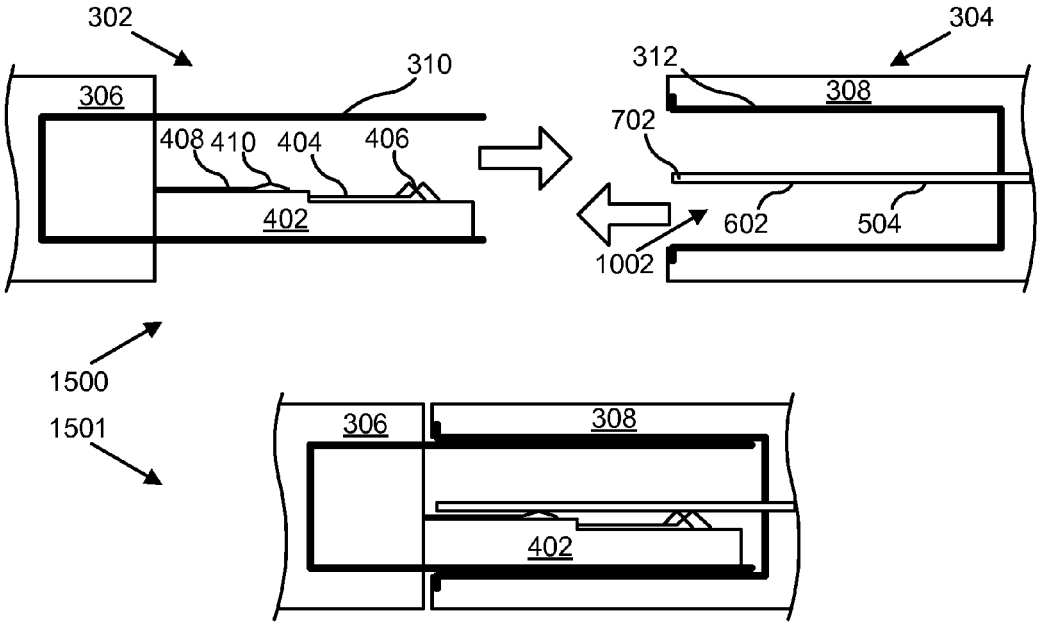
FIG. 15 is a lateral sectional view of a symmetrical hybrid male connector engaging a hybrid female connector in one orientation.

FIG. 15 is a lateral sectional view of a symmetrical hybrid male connector 302 engaging a hybrid female connector 304 in one orientation. The male connector 302 has contacts 404 and 408 disposed on male substrate 402. The female connector has contacts 504 and 602 disposed on bottom contacting surface 1002 of a tongue 702. The tongue 702 has a similar layout to that of the hybrid reversible tongue 702 depicted in FIGS. 11-14, except that it is inverted and the terminals 802 and 1202 are positioned at its opposite edge. The female contacts 504 and 602 are mounted flat against the tongue 702 and thus not directly visible in this view, but they correspond positionally to the male contacts 404 and 408, so as to make contact with and slightly compress the elastic portions 406 and 410 when a connection is made by inserting the male connector 302 into the female connector 304, transitioning from an open position 1500 to a closed position 1501.

Observe that the tongue 702 is cantilevered out from the female housing 308, thus reducing deflection of the tongue 702 when the elastic portions 406 and 410 of the male contacts 404 and 408 are compressed against the flat female contacts 504 and 602, insuring satisfactory electrical continuity. In a further embodiment, the tongue 702 may be constructed of a thin but rigid material in order to further minimize deflection under pressure. In an embodiment, the rigid material may comprise a high-strength laminate such as fiberglass or the like.

Figure 16:
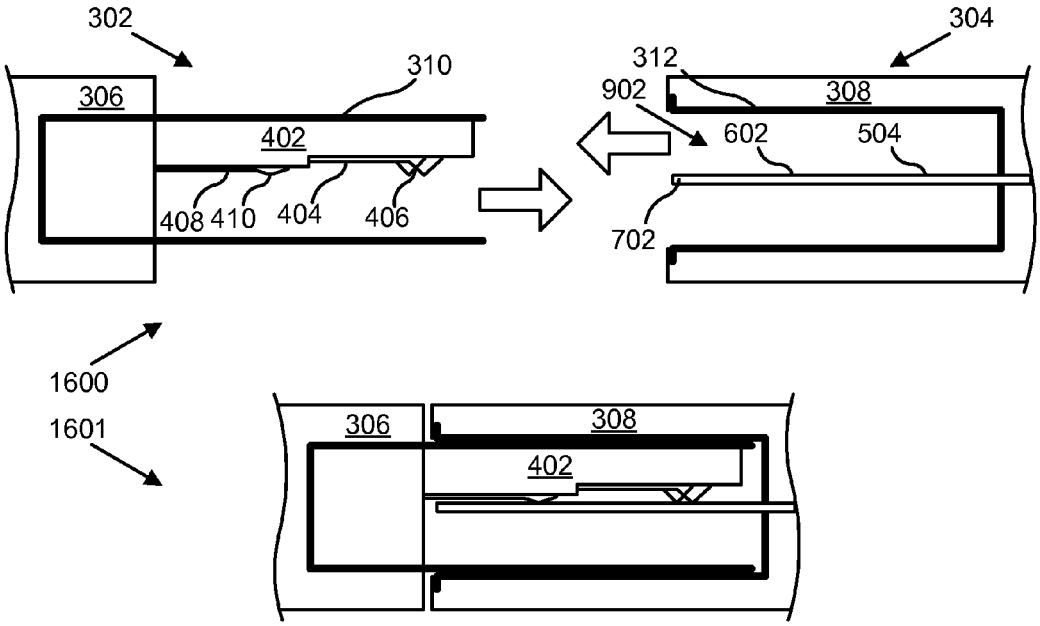
FIG. 16 is a lateral sectional view of a symmetrical hybrid male connector engaging a hybrid female connector in a reversed orientation.

FIG. 16 is a lateral sectional view of a symmetrical hybrid male connector 302 engaging a hybrid female connector 304 in a reversed orientation. The male connector 302 has contacts 404 and 408 disposed on male substrate 402. The female connector has contacts 504 and 602 disposed on top contacting surface 902 of the tongue 702. The female contacts 504 and 602 are mounted flat against the tongue 702 and thus not directly visible in this view, but they correspond positionally to the male contacts 404 and 408, so as to make contact with and slightly compress the elastic portions 406 and 410 when a connection is made by inserting the male connector 302 into the female connector 304, transitioning from an open position 1600 to a closed position 1601.

In an alternate embodiment, the tongue 702 and its associated flat contacts 504 and 602 could have been installed in the male connector 302, with the substrate 402 and its associated elastic contacts 404 and 408 being installed in the female connector 304, and the connection between connectors 302 and 304 would still have worked properly, both mechanically and electrically. In other words, the internal structure of the connectors 302/304 is interchangeable, independent of gender.

Figure 17:
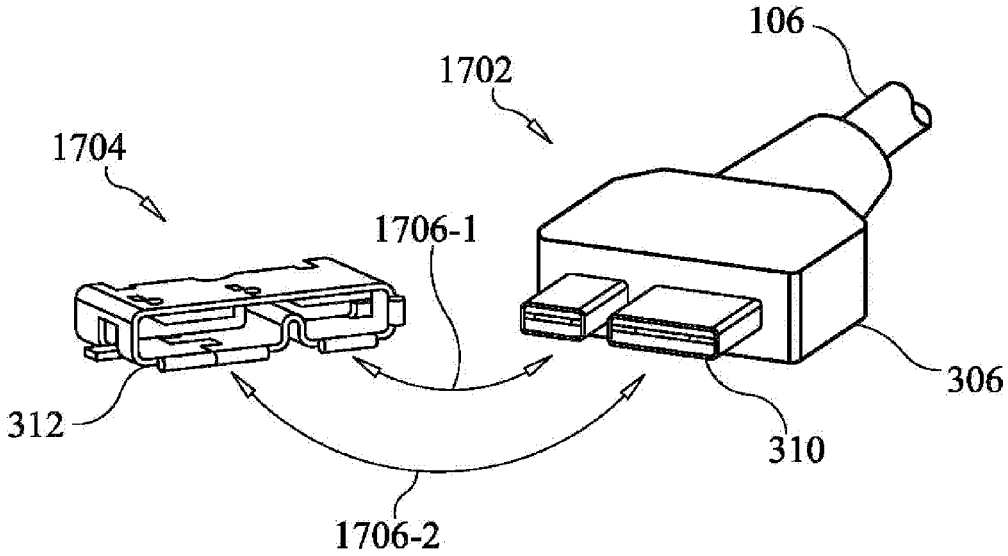
FIG. 17 is a perspective view of a composite hybrid male connector engaging a composite hybrid female connector.

FIG. 17 is a perspective view of a composite hybrid male connector 1702 engaging a composite hybrid female connector 1704. Each connector 1702/1704 is composite in that it may independently accept a first subconnection 1706-1 and/or a second subconnection 1706-2. Each connector 1702/1704 is also hybrid in that a first subset of contacts corresponding to the first subconnection 1706-1 and a second subset of contacts corresponding to the second subconnection 1706-2 are arranged in separate rows and operate independently of one another. However, composite connector 1702/1704 has the additional property that each subset of contacts is physically accessible without necessarily obstructing access to any other subset of contacts. In a further embodiment, there may be more than two subconnections 1706.

In an embodiment, the composite connectors 1702 and 1704 may be Micro Type B USB 3.0 connectors. In various further embodiments, the subconnection 1706-1 may be compatible with the USB 3.0 and the subconnection 1706-2 may be compatible with USB 2.0.

Figure 18:
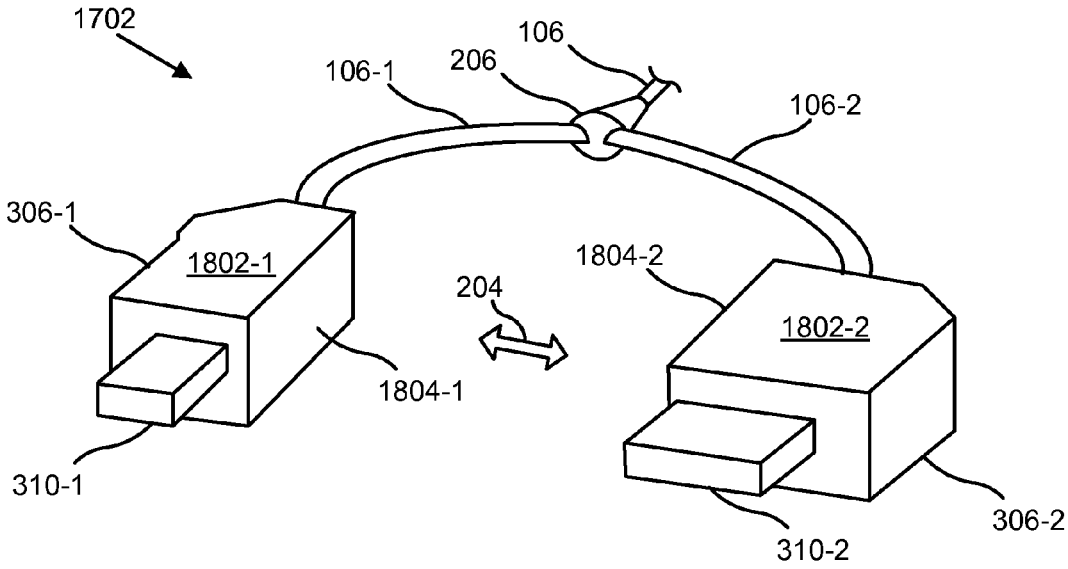
FIG. 18 is a perspective view of the composite male connector divided into subconnectors that are harnessable by mating corresponding subconnector faces together.

FIG. 18 is a perspective view of the composite male connector 1702 divided into subconnectors 1802 that are harnessable 204 by mating corresponding subconnector faces 1804 together. The housing 306 may be divided into a first housing 306-1 and a second housing 306-2, the shell 310 may be likewise divided in a first shell 310-1 and a second shell 310-2, and the cable 106 may be likewise divided by a splitter module 206 into a first split cable 106-1 and a second split cable 106-2.

In one embodiment, the harness 204 may comprise a user holding the subconnectors 1802 together in proper alignment by hand to form composite connector 1702. In another embodiment the harness 204 may comprise connecting the subconnectors 1802 to an undivided composite connector 1704 of opposite gender. In an embodiment, the first subconnector 1802-1 may be compatible with USB 3.0, and the second subconnector 1802-2 may be a Micro Type B USB 2.0 connector.

Figure 19:
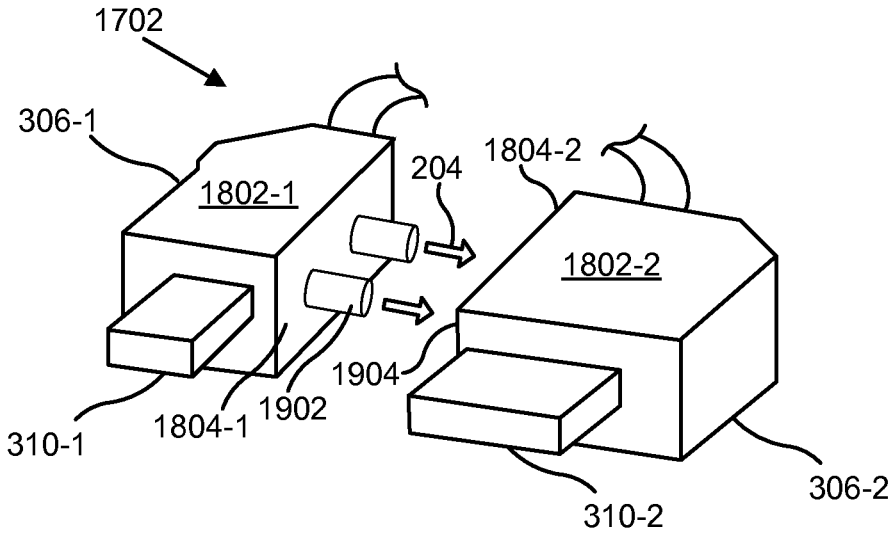
FIG. 19 is a perspective view of the subconnectors, harnessable by pins and holes for mating alignment.

FIG. 19 is a perspective view of the subconnectors 1802, harnessable 204 by pins 1902 and holes 1904 for mating alignment of subconnector faces 1804. Each pin 1902 on subconnector face 1804-1 fits into a corresponding hole 1904 in subconnector face 1804-2, so as to hold subconnectors 1802 together in proper alignment to form composite connector 1702.

Figure 20:
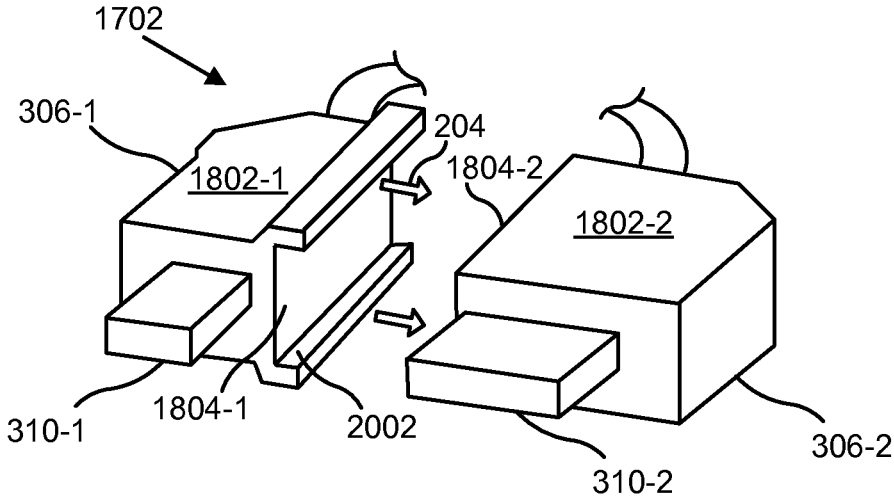
FIG. 20 is a perspective view of the subconnectors, harnessable by a friction fit for mating alignment.

FIG. 20 is a perspective view of the subconnectors 1802, harnessable 204 by a friction fit 2002 for mating alignment of subconnector faces 1804. Subconnector face 1804-2 fits snugly into the cavity created around subconnector face 1804-1 by friction fit 2002, so as to hold subconnectors 1802 together in proper alignment to form composite connector 1702.

Figure 21:
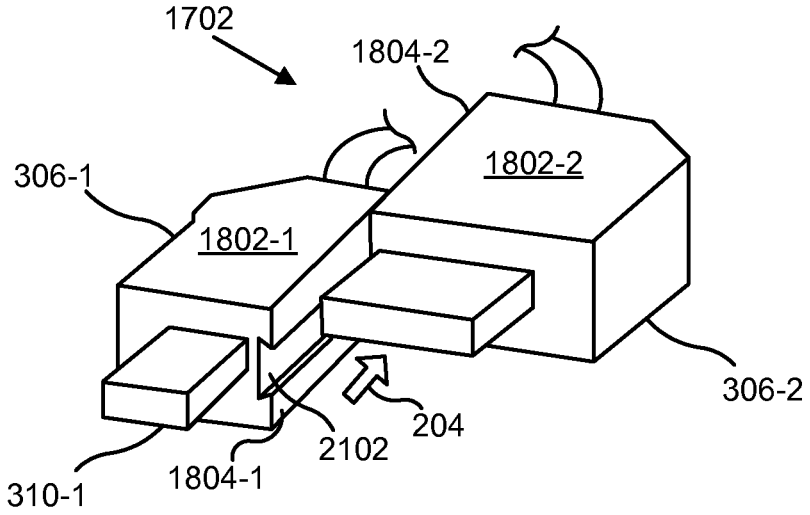
FIG. 21 is a perspective view of the subconnectors, harnessable by a keyed slot for mating alignment.

FIG. 21 is a perspective view of the subconnectors 1802, harnessable 203 by a keyed slot 2102 for mating alignment of subconnector faces 1804. The slot 2102 on subconnector face 1804-1 slides onto a corresponding identically shaped key (not visible in this view) on subconnector face 1804-2, so as to hold subconnectors 1802 together in proper alignment to form composite connector 1702.

Figure 22:
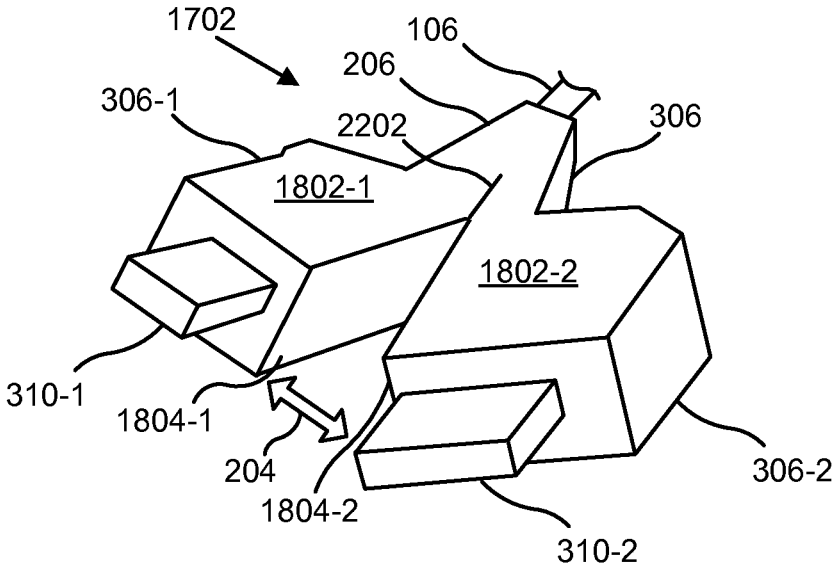
FIG. 22 is a perspective view of the subconnectors, harnessable by a flexible joint between them along a common edge for mating alignment.

FIG. 22 is a perspective view of the subconnectors 1802, harnessable 204 by a flexible joint 2202 between them along a common edge for mating alignment of subconnector faces 1804. In one embodiment the flexible joint may comprise a hinge. In another embodiment the flexible joint may comprise soft, bendable plastic from which the housing 306 may be formed, such as by injection molding. An undivided portion of the housing 306 between the cable 106 and the flexible joint 2202 may house the splitter module 206, eliminating the need for split cables 106-1 and 106-2 of FIG. 18.

Figure 23:
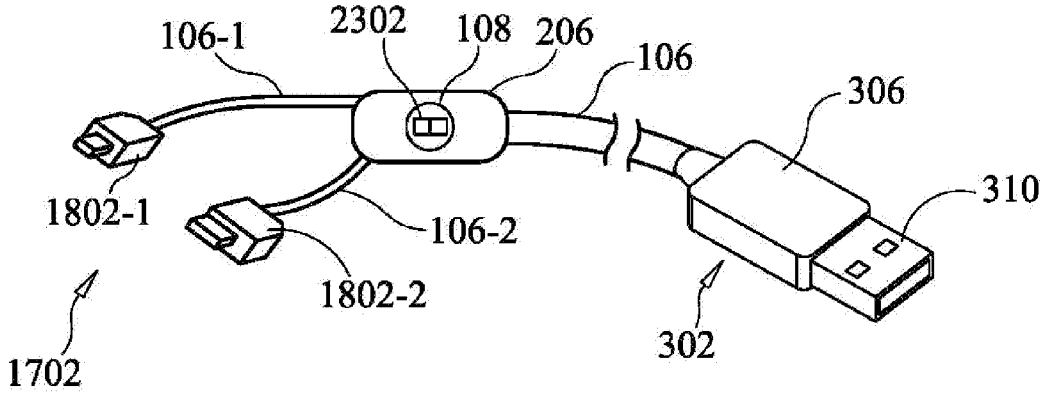
FIG. 23 is a perspective view of the system with an integrated splitter module and switching module comprising a switch in line with the cable.

FIG. 23 is a perspective view of the system 100 with an integrated splitter module 208 and switching module 108 comprising a switch 2302 in line with the cable 106. In the embodiment shown, one end of the cable 106 is attached to a male hybrid connector 302, which may or may not be symmetric, and the other end of the cable is divided by the splitter module into split cables 106-1 and 106-2 which are attached respectively to subconnectors 1802-1 and 1802-2, the subconnectors 1802 together comprising a male composite connector 1702.

Figure 24:
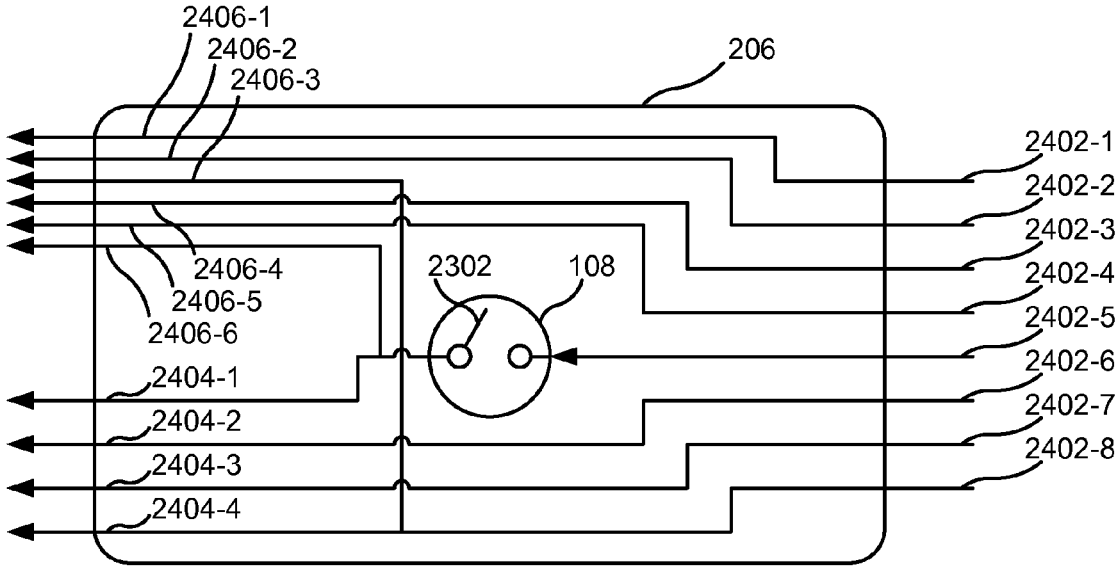
FIG. 24 is a schematic block diagram of the integrated splitter module and switching module comprising the switch.

FIG. 24 is a schematic block diagram of the integrated splitter module 208 and switching module 108 comprising the switch 2302. In the embodiment shown, the splitter 208 divides the set of signals 2402 into subsets 2404 and 2406 of the signals. Signal 2402-5 may be a power signal that is turned on and off by switching module 108 using switch 2302. In an embodiment, the switch 2303 may be mechanical.

In the embodiment shown, the switched power signal 2402-5 is distributed to both subsets 2404 and 2406 as power signal 2404-1 and 2406-6, respectively. In one embodiment, the signals 2404-1:4 may be compatible with USB 2.0, and the signals 2406-1:5 may be compatible with USB 3.0 In a further embodiment, power signal 2406-6 may comprise a backward-compatible enhancement to USB 3.0. As a variant of the foregoing embodiments, the switching module 108 and the switch 2303 may be omitted, making the power signal 2402-5 hard-wired instead of switched.

Figure 25:
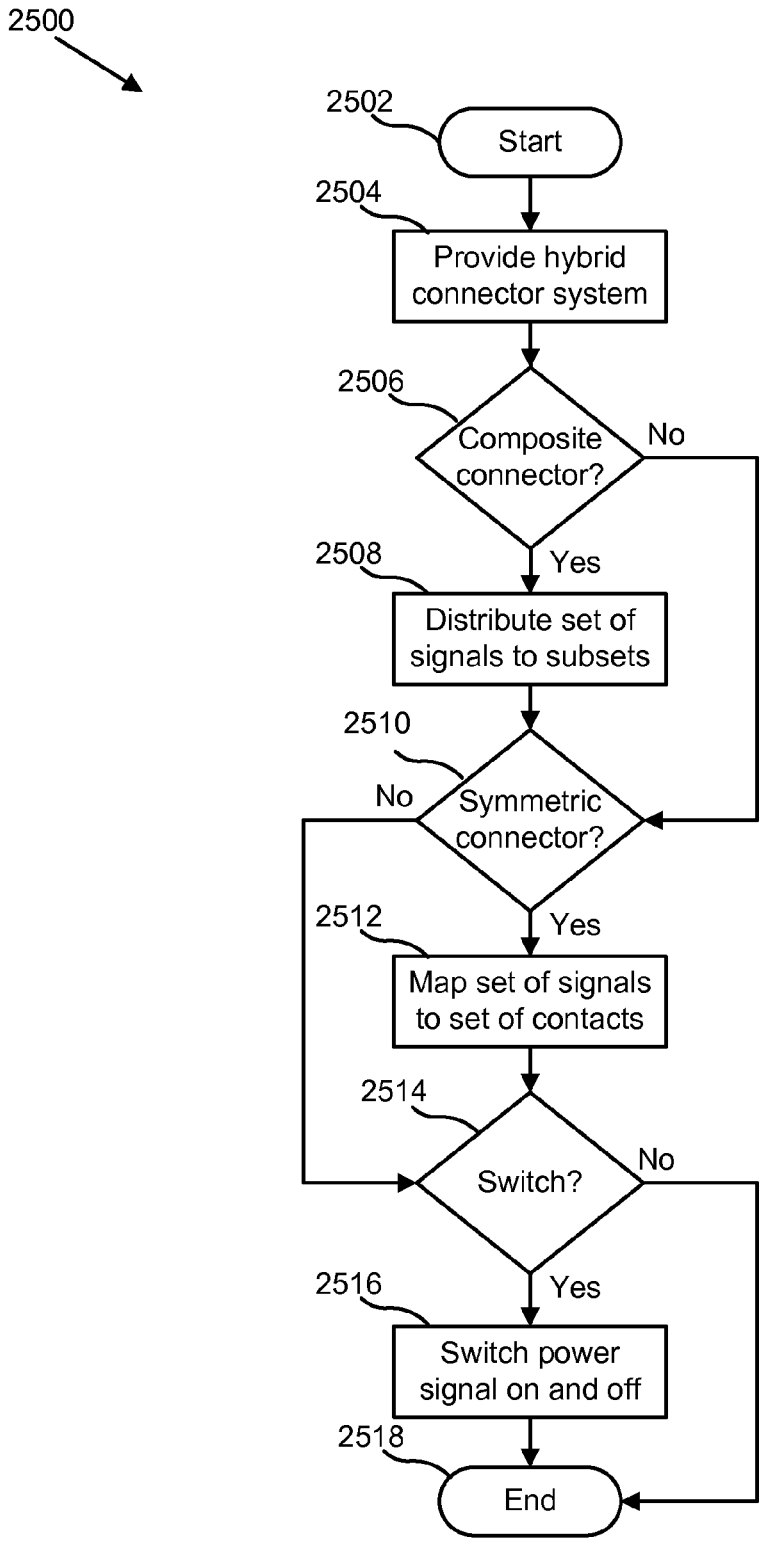
FIG. 25 is a schematic flow chart diagram illustrating a method for composite and symmetrical hybrid connectors, in accordance with the present invention.

FIG. 25 is a schematic flow chart diagram illustrating a method for composite and symmetrical hybrid connectors, in accordance with the present invention. The method 2500 starts 2502 and provides 2504 the hybrid connector system 100. If the composite connector apparatus 102 is provided 2506 then the splitter module 206 distributes 2508 the set 2402 of signals to subsets 2404/2406 of the signals. If the symmetrical connector apparatus 104 is provided 2510 then the mapper module 212 maps 2512 the set 2402 of signals to each set of contacts 404/408. If the switch 2302 is provided 2514 then the switching module 108 switches 2516 the power signal 2402-5 on and off. When each of the foregoing provided elements of the system 100 has been processed then the method 2500 ends 2518.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a composite electronic connector comprising a set of signals, the composite connector being divisible into multiple subconnectors, each subconnector comprising a subset of the signals;

a harness that combines the subconnectors, comprising corresponding subconnector faces that mate together; and a splitter module that distributes the set of signals to the subsets of the signals wherein the splitter module comprises one or more of logic hardware and executable code, the executable code stored on one or more non-transitory computer-readable media;

wherein the corresponding subconnector faces comprise a flexible joint between them along a common edge for mating alignment.

2. The apparatus of claim 1, wherein mating alignment of the corresponding subconnector faces is achieved by connecting the subconnectors to an undivided composite connector of opposite gender.

3. The apparatus of claim 1, wherein the corresponding subconnector faces comprise pins and holes for mating alignment.

4. The apparatus of claim 1, wherein the corresponding subconnector faces comprise a friction fit for mating alignment.

5. The apparatus of claim 1, wherein the corresponding subconnector faces comprise a keyed slot for mating alignment.

6. The apparatus of claim 1, wherein the composite connector comprises a Micro Type B Universal Serial Bus ("USB") 3.0 connector.

7. An apparatus comprising:

a symmetrical electronic connector comprising a set of signals, the symmetrical connector being connectable in more than one orientation;

a tongue disposed within the symmetrical connector, the tongue having more than one contacting surface, each contacting surface comprising a set of contacts; and a mapper module that maps the signals to the contacts so as to achieve a correct connection independent of the orientation of the symmetrical connector wherein the mapper module comprises one or more of logic hardware and executable code, the executable code stored on one or more non-transitory computer-readable media.

8. The apparatus of claim 7, wherein the symmetrical connector is male.

9. The apparatus of claim 7, wherein the symmetrical connector is female.

10. The apparatus of claim 7, wherein the set of contacts is arranged in multiple rows, each row comprising a subset of the signals.

11. The apparatus of claim 7, wherein the symmetrical connector comprises a Standard Type A Universal Serial Bus ("USB") connector.

12. A system comprising:

a composite electronic connector comprising a set of signals including a power signal, the composite connector being divisible into multiple subconnectors, each subconnector comprising a subset of the signals;

a harness that combines the subconnectors, comprising corresponding subconnector faces that mate together;

a splitter module that distributes the set of signals to the subsets of the signals;

a symmetrical electronic connector comprising the set of signals, the symmetrical connector being connectable in more than one orientation;

a tongue disposed within the symmetrical connector, the tongue having more than one contacting surface, each contacting surface comprising a set of contacts;

a mapper module that maps the signals to the contacts so as to achieve a correct connection independent of the orientation of the symmetrical connector; and a cable between the composite connector and the symmetrical connector wherein the splitter module and the mapper module comprise one or more of logic hardware and executable code, the executable code stored on one or more non-transitory computer-readable media.

13. The system of claim 12, further comprising a switching module that switches the power signal on and off, wherein the switching module comprises one or more of logic hardware and executable code, the executable code stored on one or more non-transitory computer-readable media.

14. The system of claim 13, wherein the switching module comprises a mechanical switch in line with the cable.

15. The system of claim 12, wherein the splitter module distributes the power signal to more than one of the subsets of the signals.

16. The system of claim 12, wherein the composite connector comprises a Micro Type B Universal Serial Bus ("USB") 3.0 connector and the symmetrical connector comprises a Standard Type A USB connector.

17. A machine-implemented method comprising the steps of:

providing composite electronic connector comprising a set of signals, the composite connector being divisible into multiple subconnectors, each subconnector comprising a subset of the signals;

providing a harness that combines the subconnectors, comprising corresponding subconnector faces that mate together;

distributing the set of signals to the subsets of the signals;

providing a symmetrical electronic connector comprising the set of signals, the symmetrical connector being connectable in more than one orientation;

providing a tongue disposed within the symmetrical connector, the tongue having more than one contacting surface, each contacting surface comprising a set of contacts; and mapping the signals to the contacts so as to achieve a correct connection independent of the orientation of the symmetrical connector.

18. The method of claim 17, further comprising the step of switching a power signal on and off.

* * * * *